US005188372A

United States Patent [19]

Tadej

[11] Patent Number: 5,188,372

[45] Date of Patent: Feb. 23, 1993

[54] DART BOARD WIRE

[76] Inventor: John Tadej, 675 Hanson Ave., Perth Amboy, N.J. 08861

[21] Appl. No.: 823,338

[22] Filed: Jan. 21, 1992

[51] Int. Cl.[5] ..... F41J 3/00

[52] U.S. Cl. ..... 273/408

[58] Field of Search ..... 273/408

[56] References Cited

U.S. PATENT DOCUMENTS

| | | | |
|---|---|---|---|
| 4,262,910 | 4/1981 | Stone et al. | 273/408 |
| 4,972,162 | 5/1990 | Kicks et al. | 273/408 |
| 4,982,967 | 1/1991 | Kicks | 273/408 |

FOREIGN PATENT DOCUMENTS

| | | | |
|---|---|---|---|
| 2026879 | 2/1980 | United Kingdom | 273/408 |
| 2069854 | 9/1981 | United Kingdom | 273/408 |

*Primary Examiner*—Paul E. Shapiro

*Attorney, Agent, or Firm*—Michael I. Kroll

[57] ABSTRACT

An improved dart board wire is provided for a dart board which consists of an elongated slender rod attached to the front surface of the dart board in various positions to indicate point scoring areas on the dart board. A structure is on the elongated slender rod, for deflecting a point of a needle on a dart onto the dart board to stick thereto, when the point of the needle on the dart strikes the elongated slender rod after being thrown thereto.

1 Claim, 2 Drawing Sheets

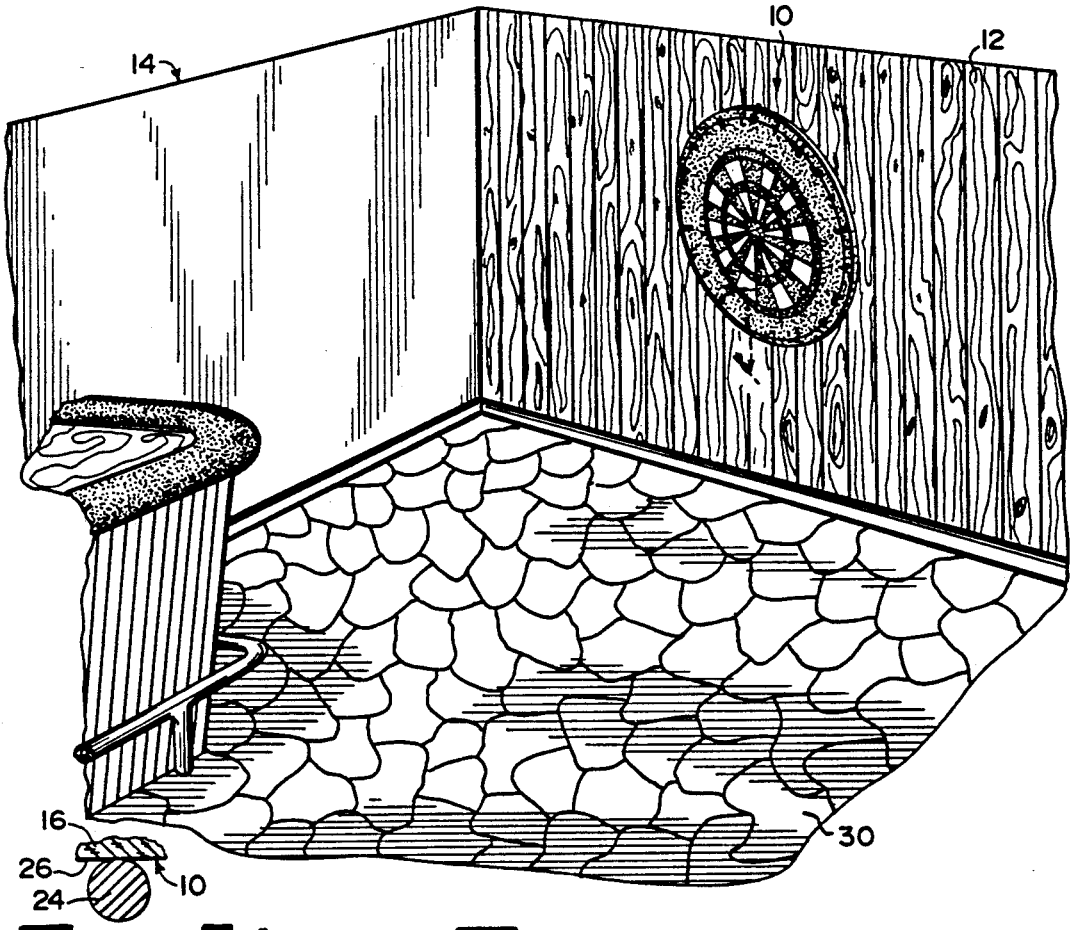
Fig. 2A
(PRIOR ART)
Fig. 1
(PRIOR ART)
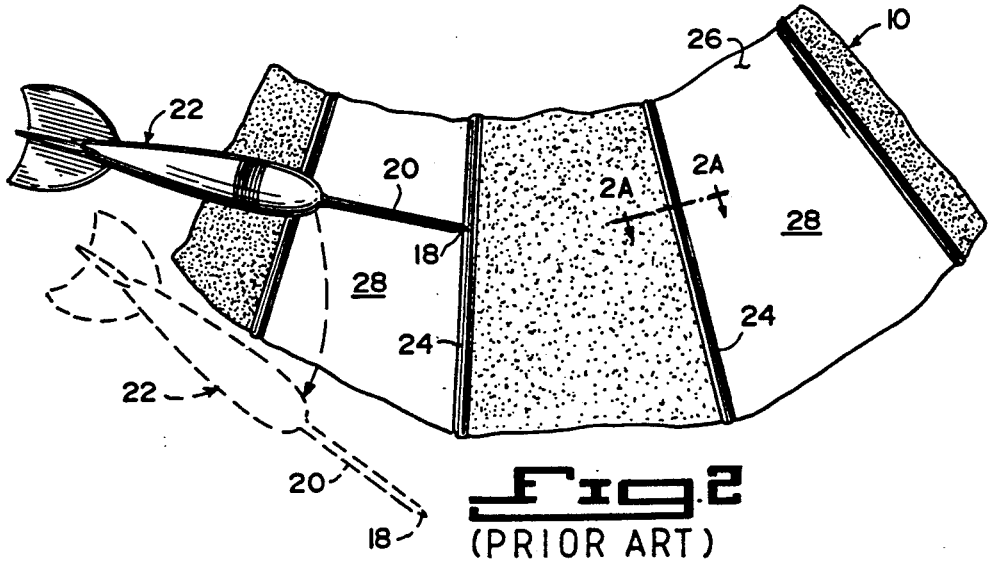
Fig. 2
(PRIOR ART)

DART BOARD WIRE

BACKGROUND OF THE INVENTION

1. Field of the Invention

The instant invention relates generally to dart boards and more specifically it relates to an improved dart board wire.

2. Description of the Prior Art

Numerous dart boards have been provided in prior art that are adapted to be made of cork or other materials to receive and retain a needle point of a dart thrown thereto and circular shaped wires arranged on the dart board to indicate point scoring areas. While these units may be suitable for the particular purpose to which they address, they would not be as suitable for the purposes of the present invention as heretofore described.

SUMMARY OF THE INVENTION

The improved dart board wire is a new replacement for the old conventional prior art dart board wire. The problem with the old conventional prior art dart board wire is that the point of a needle on a dart will sometimes hit this old wire, then fall to the floor.

To solve this problem, inventors have come up with numerous different changes for the darts. The improved dart board wire approaches the problem from a different angle, whereby instead of changing the dart, the old wire is changed instead.

The old conventional prior art dart board wire is completely curved about its circumference. The new improved dart board wire is curved just at the back being the part that is adjacent to the dart board, but then tapers to a narrow front edge, so that the front edge is essentially angular when the point of the needle on the dart hits the new wire, instead of striking it and then falling to the floor, the narrow front edge of the new wire will cause the needle point to be deflected onto the dart board itself and stick there. A dart thrown for the bulls eye is much more likely to reach its intended target with this invention, rather than bounce off the old wire onto the floor where it is a big disappointment for the player.

Darts enthusiasts will be reassured to know that the improved dart board wire admirably solves this problem that has long plagued them. It may be produced at a price comparable to that of the old conventional prior art dart board wire.

A primary object of the present invention is to provide an improved art board wire that will overcome the shortcomings of the prior art devices.

Another object is to provide an improved dart board wire that contains a tapered narrow angular shaped front edge, so that the needle point of a dart hitting the new wire will be deflected towards the dart board and stick there instead of falling to the floor.

An additional object is to provide an improved dart board wire in which a cover member having a tapered narrow angular shaped front edge can be attached to the dart board over the old conventional prior art dart board wire, to deflect the needle point of the dart which will normally hit the old wire.

A further object is to provide an improved dart board wire that is simple and easy to use.

A still further object is to provide an improved dart board wire that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the prior art being a standard dart board with conventional wires thereon mounted to a wall of a building.

FIG. 2 is an enlarged perspective view of a portion of the standard dart board as in FIG. 1, showing a dart striking the conventional wire and falling therefrom in phantom.

FIG. 2A is an enlarged cross sectional view taken along line 2A—2A in FIG. 2.

DETAILED DESCRIPTION OF THE PREFERRED EMBODIMENTS

Figure 3:
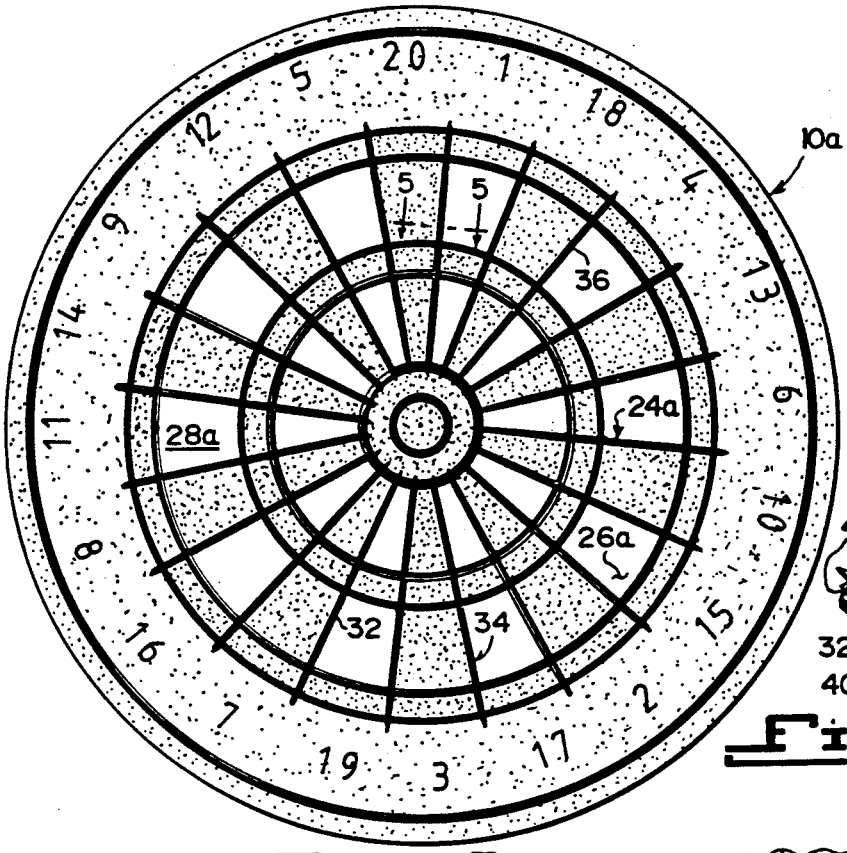
FIG. 3 is a front view of a dart board with the instant invention thereon.

Turning now descriptively to the drawings, in which similar reference characters denote similar element throughout the several views, FIGS. 1, 2 and 2A illustrate the prior art being a dart board 10 that is a target for a game of darts. The dart board 10 is mounted on a wall 12 of a building 14 and is made out of cork 16 or other materials which is intended to receive and retain a point 18 of a needle 20 on a dart 22 thrown thereto. Wires 24 are arranged on the front surface 26 of the dart board 10 in various positions to indicate point scoring areas 28.

When the dart 22 is thrown slightly off a desired scoring area 28 it can contact the wire 24 on the dart board 10. This will result in a bounce out, whereby the point 18 of the needle 20 on the dart 22 is rejected by the wire 24 on the dart board 10, causing it to bounce off the wire 24 and land on a floor 30 below the dart board 10.

Another cause of the dart board 10 rejecting the dart 22 can occur when the point 18 of the needle 20 on the dart 22 glances off the wire 24. It does not contain a sufficient force to retain penetration into the dart board 10 and is referred to as a fall out.

When the dart 22 bounces out or falls out of the dart board 10, a player will receive no score for the throw. A single occurrence of a bounce out or a fall out by even a most skillful dart player can determine who will win the game.

The wire 24 on the dart board 10 is approximately between 0.056 and 0.062 of an inch in diameter. The wire 24 is completely circular in cross section, as best seen in FIG. 2A, and it is evident that only the top one hundred and eighty degrees of its circumference is subject to the impact of the point 18 of the needle 20 on the dart 22.

The needle point 18 striking the top dead center of the circumference of the wire 24 has a high probability of resulting in a bounce out. The needle point 18 striking the wire 24 within an arc of forty five degrees on either side of the top dead center is potentially subject to a bounce out and the possibility of a fall out due to loss of momentum of the dart 22 as a result of striking the wire 24.

The probability of a bounce out decreases as the needle point 18 impact moves away from the top dead center. The probability that the needle point 18, which impacts the wire 24 more than forty five degrees from the top dead center, will bounce or fall out is very low. This observation must be tempered by noting that the top dead center is a specific location with respect to the relationship of the wire 24 to the dart board 10, whereas it is a variable location with respect to the thrown dart 22, which depends on the trajectory and attitude of the dart 22.

The instant invention, as shown in FIGS. 3 through 6 is an improved art board wire 24*a* for a dart board 10*a*, which consists of an elongated slender rod 32 attached to the front surface 26*a* of the dart board 10*a* in various positions to indicate point scoring areas 28*a* on the dart board 10*a*. A structure 34 is on the elongated slender rod 32 for deflecting the point 18 of the needle 20 on the dart 22 onto the dart board 10*a* to stick thereto, when the point 18 of the needle 20 on the dart 22 strikes the elongated slender rod 32 after being thrown thereto.

The elongated slender rod 32 is fabricated out of a durable metal material and is curved just at the back being the part that is adjacent to the front surface of the dart board 10*a*.

Figure 7:
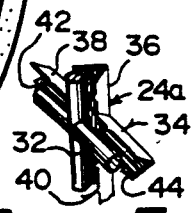
FIG. 7 is a perspective view of a portion of a modification of the instant invention ready to cover a portion of the old conventional dart board wire.
Figure 5:
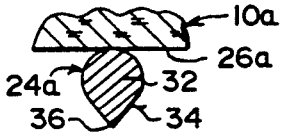
FIG. 5 is an enlarged cross sectional view taken along line 5—5 in FIG. 3.
Figure 4:
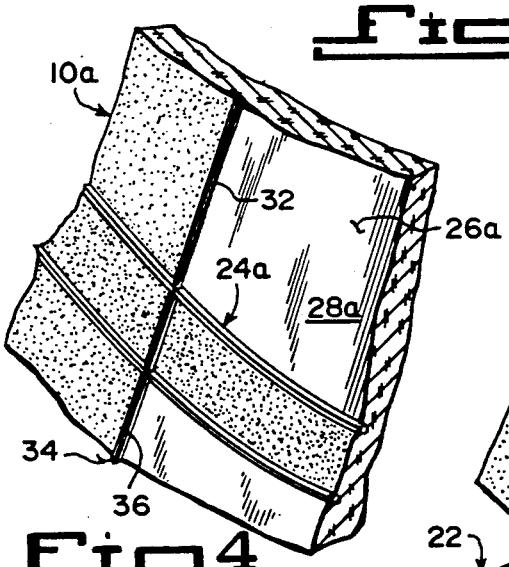
FIG. 4 is an enlarged perspective view of a portion of the dart board as in FIG. 3.
Figure 6:
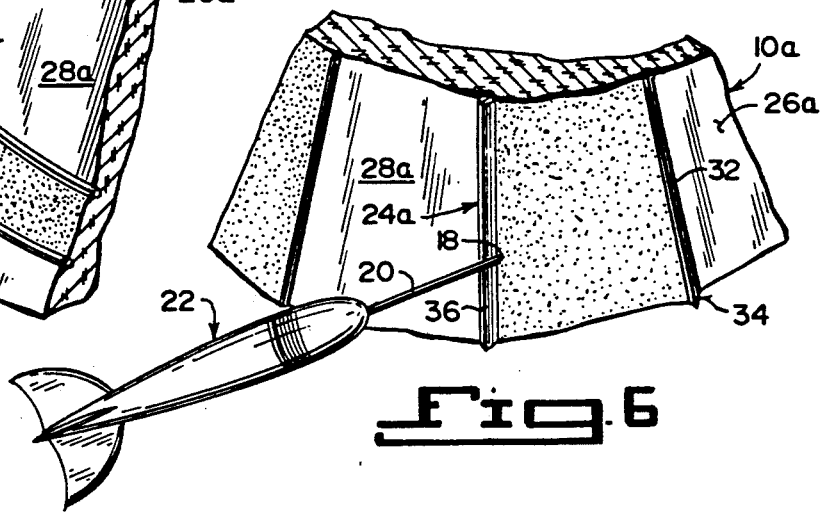
FIG. 6 is an enlarged perspective view of a portion of the dart board as in FIG. 3 showing a dart being deflected from the instant invention.

The deflecting structure 34 includes a tapered narrow angular shaped front edge 36 formed on the elongated slender rod 32, so that the point 18 of the needle 20 of the dart 22 will turn aside and enter the dart board 10*a* when striking the tapered narrow angular shaped front edge 36 on the elongated slender rod 32. A second embodiment of the instant invention is shown in FIG. 7, as the improved dart board wire 24*a* for the dart board 10*a*, wherein the elongated slender rod 32 is completely curved about its circumference as is the old wire 24.

The deflecting structure 34 includes a cover member 38 having the tapered narrow angular shaped front edge 36. Fasteners 40 are for attaching the cover member 38 to the front surface 26*a* of the dart board 10*a* over the elongated slender rod 32, so that the point 18 of the needle 20 on the dart 22 will turn aside and enter the dart board 10*a* when striking the tapered narrow angular shaped front edge 36 on the cover member 38.

The attaching fasteners 40 are a plurality of spaced apart pointed prongs 42 extending downwardly from each bottom edge 44 on the cover member 38 to stick into the dart board 10*a*.

The cover member 38 is fabricated out of a durable metal material. Each pointed prong 42 is fabricated out of a durable metal material. The cover member 38 and the pointed prongs 42 are fabricated out of the same durable metal material. They are integral being made out of one complete unit, so as to fit over the elongated slender rod 32 and be attached to the front surface 26*a* of the dart board 10*a*.

LIST OF REFERENCE NUMBERS

10 prior art dart board
10*a* a new dart board
12 wall
14 building
16 cork
18 point
20 needle
22 dart
24 old dart board wire
24*a* a improved dart board wire
26 front surface of 10
26*a* a front surface of 10*a*
28 point scoring area on 10
28*a* a point scoring area on 10*a*
30 floor
32 elongated slender rod
34 deflecting structure on 32
36 a tapered narrow angular shaped front edge
38 cover member
40 fastener
42 pointed prong
44 bottom edge on 38

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved dart board wire for a dart board which comprises:

a) an elongated slender rod attached to the front surface of the dart board in various positions to indicate point scoring areas on the dart board, said elongated slender rod being fabricated out of a durable metal material, said elongated slender rod being completely curved about its circumference; and b) means on said elongated slender rod for deflecting a point of a needle on a dart onto the dart board to stick thereto when the point of the needle on the dart strikes said means after being thrown thereto, said deflecting means include a cover member having a tapered narrow angular shaped front edge and said cover member being fabricated out of a durable metal material, and said deflecting means further including means for attaching said cover member to the front surface of the dart board over said elongated slender rod so that the point of the needle on the dart would turn aside and enter the dart board when striking said tapered narrow angular shaped front edge on said cover members, said attaching means includes a plurality of spaced apart pointed prongs extending downwardly from each bottom edge on said cover member to stick into the dart board, each of said pointed prongs being fabricated out of a durable metal material, said cover member and said pointed prongs are fabricated out of the same durable metal material, said cover member and said pointed prongs are integral and being made as one complete homogeneous unit, so as to fit over said elongated slender rod and be attached to the front surface of the dart board.

* * * * *